United States Patent [19]

Glandt et al.

[11] Patent Number: 5,060,726

[45] Date of Patent: Oct. 29, 1991

[54] METHOD AND APPARATUS FOR PRODUCING TAR SAND DEPOSITS CONTAINING CONDUCTIVE LAYERS HAVING LITTLE OR NO VERTICAL COMMUNICATION

[75] Inventors: Carlos A. Glandt; Harold J. Vinegar, both of Houston; John W. Gardner, West University, all of Tex.

[73] Assignee: Shell Oil Company, Houston, Tex.

[21] Appl. No.: 571,391

[22] Filed: Aug. 23, 1990

[51] Int. Cl.[5] ..... E21B 43/24; E21B 43/30

[52] U.S. Cl. ..... 166/248; 166/50; 166/60; 166/245; 166/272

[58] Field of Search ..... 166/50, 60, 65.1, 245, 166/248, 250, 272, 302, 303

[56] References Cited

U.S. PATENT DOCUMENTS

| | | | |
|---|---|---|---|
| Re. 30,738 | 9/1981 | Bridges et al. | 166/248 |
| 3,848,671 | 11/1974 | Kern | 166/248 |
| 3,958,636 | 5/1976 | Perkins | 166/248 |
| 3,986,557 | 10/1976 | Striegler et al. | 166/272 |
| 3,994,340 | 11/1976 | Anderson et al. | 166/272 |
| 4,037,658 | 7/1977 | Anderson | 166/272 |
| 4,084,637 | 4/1978 | Todd | 166/60 X |
| 4,085,803 | 4/1978 | Butler | 166/303 |
| 4,116,275 | 9/1978 | Butler et al. | 166/303 |
| 4,344,485 | 8/1982 | Butler | 166/271 |
| 4,456,065 | 6/1984 | Heim et al. | 252 X/ |
| 4,489,782 | 12/1984 | Perkins | 166/65.1 X |
| 4,545,435 | 10/1985 | Bridges et al. | 166/245 X |
| 4,567,945 | 2/1986 | Segalman | 166/65.1 X |
| 4,612,988 | 9/1986 | Segalman | 166/248 |
| 4,705,108 | 11/1987 | Little et al. | 166/248 |
| 4,926,941 | 5/1990 | Glandt et al. | 166/248 |

OTHER PUBLICATIONS

Towson, "The Electric Preheat Recovery Process," Second International Conference on Heavy crude and Tar Sand, Caracas, Venezuela, Sep., 1982.

Hiebert et al., "Numerical Simulation Results for the Electrical Heating of Athabasca Oil Sand Formations," *Reservoir Engineering Journal,* SPE, Jan. 1986.

*Primary Examiner*—George A. Suchfield

[57] ABSTRACT

An apparatus and method are disclosed for producing thick tar sand deposits by preheating of thin, relatively highly conductive layers which are a small fraction of the total thickness of a tar sand deposit, with horizontal electrodes and steam stimulation. The preheating is continued until the viscosity of the tar in a thin preheated zone adjacent to the highly conductive layers is reduced sufficiently to allow steam injection into the tar sand deposit. The entire deposit is then produced by steam flooding.

23 Claims, 3 Drawing Sheets

FIG.1
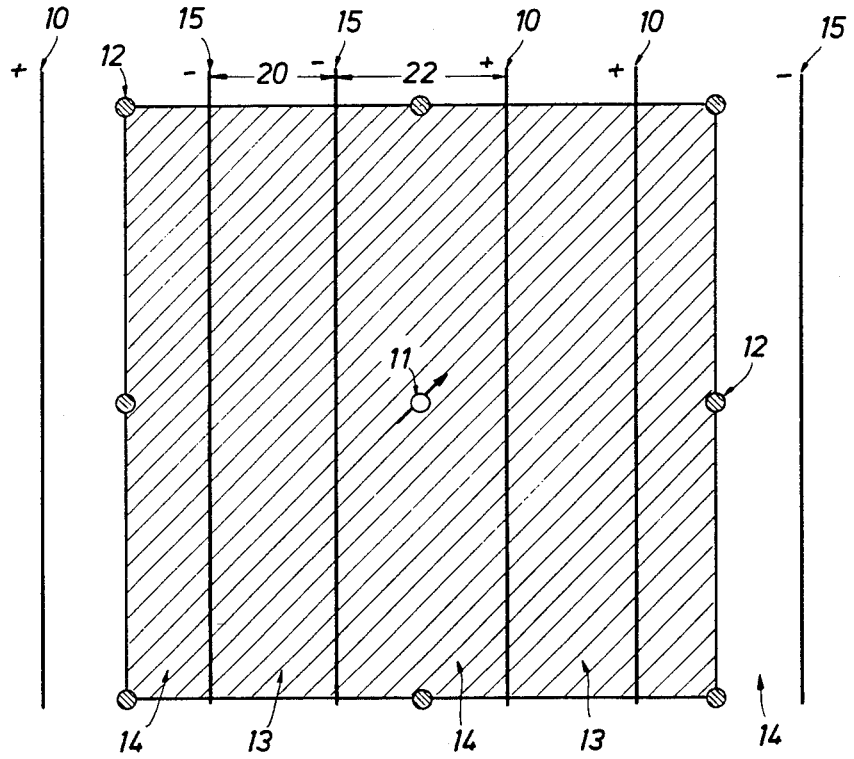
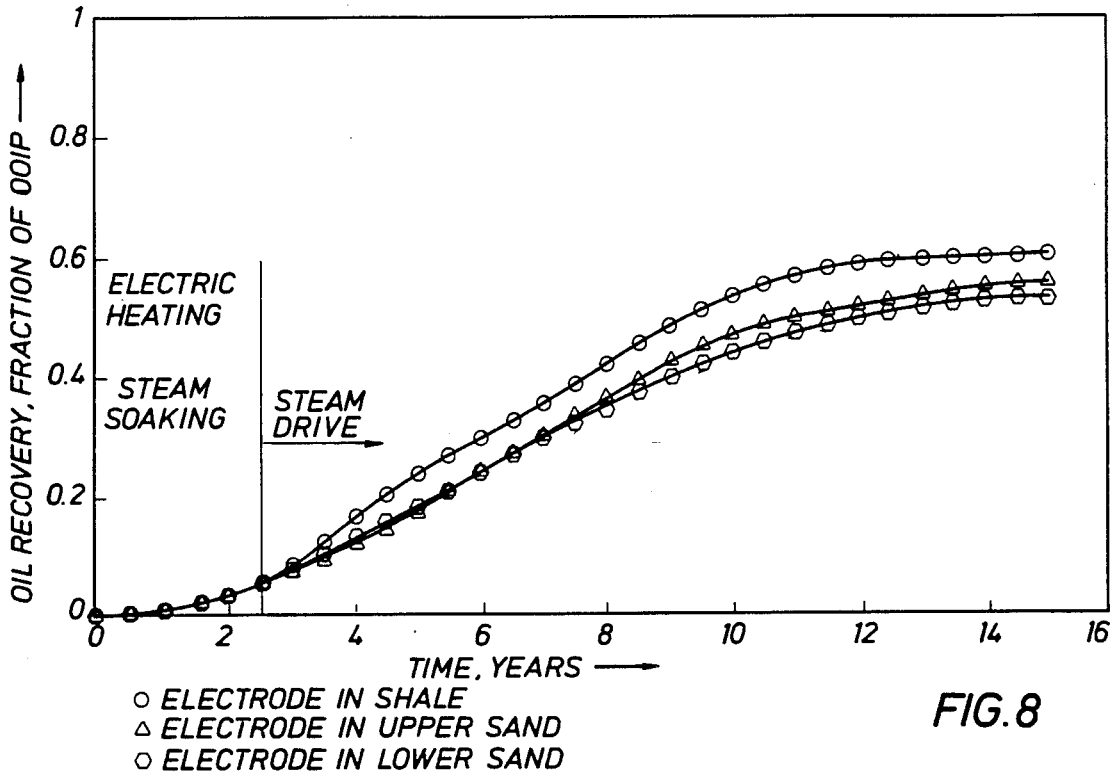
FIG.8

750
800
850
900
950
1000
1050
DEPTH (FT)
0
50
100
150
200
250
RESISTIVITY (ohm-m)

750
800
850
900
950
1000
1050
DEPTH (FT)
0.0001
0.001
0.01
0.1
1
Kv/Kh 750
800
850
900
950
1000
1050
DEPTH (FT)
0
500
1000
1500
2000
PERMEABILITY (md)

METHOD AND APPARATUS FOR PRODUCING TAR SAND DEPOSITS CONTAINING CONDUCTIVE LAYERS HAVING LITTLE OR NO VERTICAL COMMUNICATION

BACKGROUND OF THE INVENTION

This invention relates to an apparatus and method for the production of hydrocarbons from earth formations, and more particularly, to those hydrocarbon-bearing deposits where the oil viscosity and saturation are so high that sufficient steam injectivity cannot be obtained by current steam injection methods. Most particularly this invention relates an apparatus and method for the production of hydrocarbons from tar sand deposits containing layers of high conductivity and having little or no vertical hydraulic connectivity.

Heavy oil and tar sands are abundant in reservoirs in many parts of the world such as those in Alberta, Canada; Utah and California in the United States; the Orinoco Belt of Venezuela; and the USSR. The energy potential of tar sand deposits is estimated to be quite great, with the total world reserve of tar sand deposits estimated to be 2,100 billion barrels of oil, of which about 980 billion are located in Alberta, Canada, and of which 18 billion barrels of oil are present in shallow deposits in the United States.

Currently, heavy oil deposits are generally produced by steam injection to swell and lower the viscosity of the crude to the point where it can be pushed toward the production wells. In those reservoirs where steam injectivity is high enough, this is a very efficient means of heating and producing the formation. However, a large number of reservoirs contain tar of sufficiently high viscosity and saturation that initial steam injectivity is severely limited, so that even with a number of "huff-and-puff" pressure cycles, very little steam can be injected into the deposit without exceeding the formation fracturing pressure. Most of these tar sand deposits have previously not been capable of economic production.

The most difficult problem in steam flooding deposits with low injectivity is establishing and maintaining a flow channel between injection and production wells. Several proposals have been made to provide horizontal wells or conduits within a tar sand deposit to deliver hot fluids such as steam into the deposit, thereby heating and reducing the viscosity of the bitumen in tar sands adjacent to the horizontal well or conduit. U.S. Pat. No. 3,986,557 discloses use of such a conduit with a perforated section to allow entry of steam into, and drainage of mobilized tar out of, the tar sand deposit. U.S. Pat. No. 3,994,340 and 4,037,658 disclose use of such conduits or wells simply to heat an adjacent portion of deposit, thereby allowing injection of steam into the mobilized portions of the tar sand deposit.

In an attempt to overcome the steam injectivity problem, several proposals have been made for various means of electrical or electromagnetic heating of tar sands. One category of such proposals has involved the placement of electrodes in conventional injection and production wells between which an electric current is passed to heat the formation and mobilize the tar. This concept is disclosed in U.S. Pat. Nos. 3,848,671 and 3,958,636. A similar concept has been presented by Towson at the Second International Conference on Heavy Crude and Tar Sand (UNITAR/UNDP Information Center, Caracas, Venezuela, September, 1982).

A novel variation, employing aquifers above and below a viscous hydrocarbon-bearing formation, is disclosed in U.S. Pat. No. 4,612,988. In U.S. Pat. No. Re. 30738, Bridges and Taflove disclose a system and method for in-situ heat processing of hydrocarbonaceous earth formations utilizing a plurality of elongated electrodes inserted in the formation and bounding a particular volume of a formation. A radio frequency electrical field is used to dielectrically heat the deposit. The electrode array is designed to generate uniform controlled heating throughout the bounded volume.

In U.S. Pat. No. 4,545,435, Bridges and Taflove again disclose a waveguide structure bounding a particular volume of earth formation. The waveguide is formed of rows of elongated electrodes in a "dense array" defined such that the spacing between rows is greater than the distance between electrodes in a row. In order to prevent vaporization of water at the electrodes, at least two adjacent rows of electrodes are kept at the same potential. The block of the formation between these equipotential rows is not heated electrically and acts as a heat sink for the electrodes. Electrical power is supplied at a relatively low frequency (60 Hz or below) and heating is by electric conduction rather than dielectric displacement currents. The temperature at the electrodes is controlled below the vaporization point of water to maintain an electrically conducting path between the electrodes and the formation. Again, the "dense array" of electrodes is designed to generate relatively uniform heating throughout the bounded volume.

Hiebert et al ("Numerical Simulation Results for the Electrical Heating of Athabasca Oil Sand Formations," Reservoir Engineering Journal, Society of Petroleum Engineers, January 1986) focus on the effect of electrode placement on the electric heating process. They depict the oil or tar sand as a highly resistive material interspersed with conductive water sands and shale layers. Hiebert et al propose to use the adjacent cap and base rocks (relatively thick, conductive water sands and shales) as an extended electrode sandwich to uniformly heat the oil sand formation from above and below.

These examples show that previous proposals have concentrated on achieving substantially uniform heating in a block of a formation so as to avoid overheating selected intervals. The common conception is that it is wasteful and uneconomic to generate nonuniform electric heating in the deposit. The electrode array utilized by prior inventors therefore bounds a particular volume of earth formation in order to achieve this uniform heating. However, the process of uniformly heating a block of tar sands by electrical means is extremely uneconomic. Since conversion of fossil fuel energy to electrical power is only about 38 percent efficient, a significant energy loss occurs in heating an entire tar sand deposit with electrical energy.

U.S. Pat. No. 4,926,941 (Glandt et al) discloses electrical preheating of a thin layer by contacting the thin layer with a multiplicity of vertical electrodes spaced along the layer.

Geologic conditions can also hinder heating and production. For example, many formations have little or no vertical communication within the formation. This means that once the selected layer is preheated, vertical movement of the steam will be somewhat limited, thus limiting vertical transfer of heat to conduction.

It is therefore an object of this invention to provide an efficient and economic method of in-situ heat processing of tar sand and other heavy oil deposits having little or no vertical communication, wherein electrical current is used to heat thin, highly conductive layers within such deposits, utilizing a minimum of electrical and steam energy to prepare the tar sands for production by steam injection; and then to efficiently utilize steam injection to mobilize and recover a substantial portion of the heavy oil and tar contained in the deposit.

SUMMARY OF THE INVENTION

According to this invention there is provided an apparatus for recovering hydrocarbons from hydrocarbon bearing deposits containing a highly conductive layer comprising:

at least one pair of horizontal electrodes spanning the highly conductive layer and dividing the highly conductive layer into electrically heated zones and non-electrically heated zones;

at least one vertical injection well; and at least one vertical production well.

Further according to the invention there is provided a method for recovering hydrocarbons from hydrocarbon bearing deposits containing highly conductive layers comprising:

selection of a target highly conductive layer near a hydrocarbon rich zone;

installing at least one pair of horizontal electrodes spanning the target highly conductive layer and dividing the layer into electrically heated and non-electrically heated zones;

providing at least one vertical injection well for hot fluid injection into the hydrocarbon rich zone;

providing at least one vertical production well for production of hydrocarbons;

electrically heating the highly conductive layer to form a preheated hydrocarbon rich zone immediately adjacent to the highly conductive layer while simultaneously steam soaking all of the wells; and recovering hydrocarbons from the production wells.

Still further according to the invention there is provided a process for increasing the injectivity of a hydrocarbon bearing deposit containing highly conductive layers comprising:

selecting a hydrocarbon-bearing deposit which contains a thin highly conductive layer within the deposit;

installing at least one pair of horizontal electrodes spanning the highly conductive layer and dividing the layer into electrically heated and non-electrically heated zones;

providing at least one vertical injection well for hot fluid injection into the hydrocarbon rich zone;

electrically heating the highly conductive layer to form a preheated zone immediately adjacent to the highly conductive layer while simultaneously stimulating the wells with a hot fluid;

According to yet another embodiment of this invention there is provided an apparatus for increasing the injectivity of a hydrocarbon bearing deposit containing a highly conductive layer comprising:

at least one pair of horizontal electrodes spanning the highly conductive layer and dividing the highly conductive layer into electrically heated zones and non-electrically heated zones; and, at least one vertical injection well.

BRIEF DESCRIPTION OF THE DRAWINGS

FIG. 1 is a plan view of a well pattern for electrode wells for heating a tar sand deposit, and steam injection and production wells for recovering hydrocarbons from the deposit.

FIG. 8 shows the recovery of the original oil in place (OOIP) of the reservoir as a function of time.

DETAILED DESCRIPTION OF THE INVENTION

Figure 4:
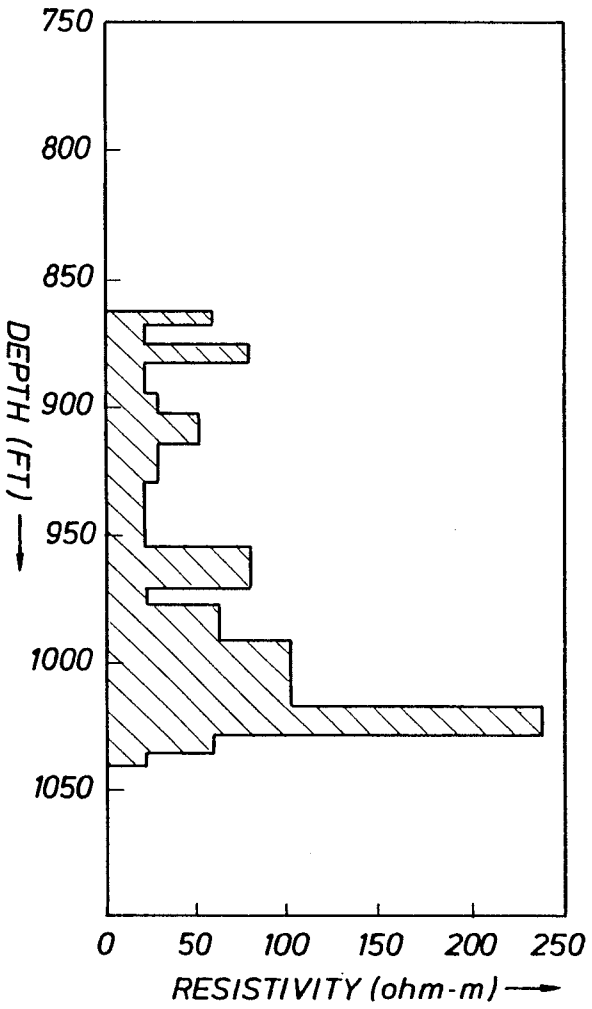
FIG. 4 shows resisitivity of a simulated reservoir as a function of depth.

Although this invention may be used in any hydrocarbon bearing formation, it is particularly applicable to deposits of heavy oil, such as tar sands, which have little or no vertical hydraulic connectivity and which contain thin highly conductive layers.

Formations with little or no vertical hydraulic connectivity will generally have geological sequences separated by interbedded continuous shale breaks. Each sequence has hydraulic continuity, but the formation as a whole is discontinuous.

The thin highly conductive layers will typically be shale layers interspersed within the tar sand deposit, but may also be water sands (with or without salinity differentials), or layers which also contain hydrocarbons but have significantly greater porosity. For geological reasons, shale layers are almost always found within a tar sand deposit because the tar sands were deposited as alluvial fill within the shale. The shales have conductivities of from about 0.2 to about 0.5 mho/m, while the tar sands have conductivities of about 0.02 to 0.05 mho/m. Consequently, conductivity ratios between the shales and the tar sands range from about 10:1 to about 100:1, and a typical conductivity ratio is about 20:1. The highly conductive layers chosen for electrical heating are preferably near a hydrocarbon rich layer. Preferably the layer chosen is adjacent to and most preferably adjacent to and below the hydrocarbon rich layer. To compare layers to determine their relative hydrocarbon richness the product of the oil saturation of the layer ($S_o$), porosity of the layer, phi, ($\phi$), and the thickness of the layer is used. Most preferably, a thin highly conductive layer near the richest hydrocarbon layer is selected.

The selected thin highly conductive layers are preferably near the bottom of a thick segment of tar sand deposit, so that steam can rise up through the deposit and heated oil can drain down into the wells. The thin highly conductive layers to be heated are additionally selected, on the basis of resistivity well logs, to provide lateral continuity of conductivity. The layers are also selected to provide a substantially higher conductivity-thickness product than surrounding zones in the deposit, where the conductivity-thickness product is defined as, for example, the product of the electrical conductivity for a thin layer and the thickness of that layer, or the electrical conductivity of a tar sand deposit and the thickness of that deposit. By selectively heating a thin layer with a higher conductivity-thickness product than that of the tar sand layer the heat generated within the thin layer is more effectively confined to that thin layer. This is possible because in a tar sand deposit the shale is more conductive than the tar sand, and may be, for example, 20 times more conductive. Thin highly conductive layers selected on this basis will substantially confine the heat generation within and around the highly conductive layers and allow much greater spacing between electrodes.

Almost any type of horizontal electrode may be utilized in this invention provided that the electrode can impart electrical current to a long horizontal section of the target highly conductive layer, without without necessarily imparting much current to the surrounding non-target layers. For this reason long horizontal electrodes having a vertical dimension of no more than the thickness of the target layer are preferred. The horizontal electrode will have a generally elongated thin geometry. Examples include long thin rectangular shapes, long small diameter shapes, as well as other long thin oblong shapes. The electrodes generally do not make electrical contact with the formation over the major thickness of the tar sand deposit, which improves the vertical confinement of the electrical current flow. This means that generally the vertical dimension of the electrode will be in the range of about 0.5 to about 10 feet. It is generally required that the current be imparted to the target highly conductive layer horizontally over about 50 to about 5000 feet. This means that the horizontal electrode will have a horizontal dimension in the range of about 50 to about 5000 feet.

Typically the horizontal electrode will be the horizontal run of a well that has been converted into a horizontal electrode by the use of conductive well casing, liner, or conductive cement. For example, electrically conductive Portland cement with high salt content or graphite filler, aluminum-filled electrically conductive epoxy, or saturated brine electrolyte, which serves to physically enlarge the effective diameter of the electrode and reduce overheating. As another alternative, the conductive cement between the electrode and the formation may be filled with metal filler to further improve conductivity. In still another alternative, the electrode may include metal fins, coiled wire, or coiled foil which may be connected to a conductive layer and connected to the sand portion of the drill hole. The effective conductivity of the electrically conductive section should be substantially greater than that of the adjacent deposit layers to reduce local heating at the electrode. The vertical run of the well is generally made non-conductive with the formation by use of a non-conductive cement.

In the present invention, the electrodes are utilized in pairs. Current will travel between the two electrodes of a pair only, and not between non-paired electrodes. The pairs of electrodes are generally in a plane at or near in depth to the target layer. The electrodes are generally positioned to "span" the high conductivity layer. Span as used herein means that as current passes between paired electrodes, at least a portion of the current travel path will be through the target highly conductive layer. Preferably, the paired electrodes will be located in or at least partially touching the target layer so that most of the current travel path is through the highly conductive layer, to maximize the application of electrical energy to the highly conductive layer. The horizontal electrodes are positioned so that the electrodes are generally parallel to each other.

The electric potential of the electrodes is such to induce current flow between paired electrodes. For each pair of electrodes there is a electrical potential between the electrodes. Although, the pairs of electrodes do not have to all be excited the same, it is generally the case that they will be because the potentials are generally supplied from one source. For any electrode pair one of the electrodes may be at ground potential and the other at an excited (either positively or negatively charged) potential, or both electrodes could be a different positive or negative potentials, or one electrode may be positively charged and the other negatively charged. For reasons explained below, for each pair of electrodes, it is preferred that one electrode be positively excited and the other negatively excited.

The electrode well pattern will be determined by an economic optimum which depends, in turn, on the cost of the electrode wells and the conductivity ratio between the thin highly conductive layer and the bulk of the tar sand deposit. Between each of the paired electrodes, there is an electrically heated zone. Each pair of electrodes is spaced apart from the neighboring pair of electrodes to allow for a cool zone between the neighboring pairs of electrodes. This prevents the electrodes from overheating. The electric potentials on the electrodes are arranged such that there is no current flow between neighboring pairs of electrodes, creating a non-electrically heated zone between the neighboring pairs of electrodes. This zone is heated only by thermal conduction. Preferably the adjacent electrodes between neighboring electrode pairs will have a similar electric potential. For example, for electrodes in a field some typical repeating patterns of electric potentials on the electrodes will be:

(+) (−) (−) (+),
(+) (++) (++) (+),
(−) (−−) (−−) (−),
(+) (0) (0) (+), or
(0) (−) (−) (0), wherein (+), (−), (++), (−−), is a positive AC potential, a negative AC potential, a more positive AC potential, and a more negative AC potential, respectively, at a given point in time. It is understood that with AC current the electrodes will be alternating between positive and negative potentials, so in the above illustration, those potentials will be alternating signs at the frequency of the supplied current.

Electrode patterns as shown above will create a cool or non-electrically heated zone between the similarly excited adjacent electrodes. The cool zone between the electrodes provides a heat sink to prevent overheating at the electrodes.

Power is generally supplied from a surface power source. Almost any frequency of electrical power may be used. Preferably, commonly available low-frequency electrical power, about 60 Hz, is preferred since it is readily available and probably more economic.

As the thin highly conductive layers are electrically heated, the conductivity of the layers will increase. This concentrates heating in those layers. In fact, for shallow deposits the conductivity may increase by as much as a factor of three when the temperature of the deposit increases from 20° C. to 100° C. For deeper deposits, where the water vaporization temperature is higher due to increased fluid pressure, the increase in conductivity can be even greater. As a result, the thin highly conductive layers heat rapidly, with relatively little electric heating of the majority of the tar sand deposit. The tar sands adjacent to the thin layers of high electrical conductivity are then heated by thermal conduction from the electrically heated shale layers in a short period of time, forming a preheated zone immediately adjacent to each thin highly conductive layer. As a result of preheating, the viscosity of the tar in the preheated zone is reduced, and therefore the preheated zone has increased injectivity. The total preheating phase is completed in a relatively short period of time, preferably no more than about two years, and is then followed by injection of steam and/or other fluids. Preferably, steam heating of the preheated zone is conducted simultaneously with the electrical heating.

A pattern of steam injection and production wells is installed in the tar sand deposit. To decrease the length of the electric heating phase, it is desired to simultaneously steam soak the wells while electrically heating. This will pose an operational problem since it is generally difficult to operate a well in electrically excited areas. However, operational problems are reduced in areas of about ground potential. The following pattern will allow for placement of the wells at a point about midway between the electrode pair in the electrically heated zone at near zero potential and is therefore preferred:

(+) (−) (−) (+)

As the target highly conductive layer is being electrically heated, it is preferred to attempt to further heat the area around the well with steam. This is accomplished by a steam "huff and puff" process, or by continuous steam injection. Early in the electrical heating stage, the preheated zone has low mobility and steam heating is quite difficult. As the electrical heating progresses, and as the adjacent preheated zone increases in temperature, the mobility of the preheated zone increases, and the steam heating becomes more effective. During the electrical heating stage, both the production and injection wells are used for steam soaking or steam stimulation. Once sufficient mobility is established, the electrical heating is discontinued and the preheated zone produced by conventional injection techniques, injecting fluids into the formation through the injection wells and producing through the producing wells.

While the formation is being electrically heated, surface measurements are made of the current flow into each electrode. Generally all of the electrodes are energized from a common voltage source, so that as the thin highly conductive layer heats and become more conductive, the current will steadily increase. Measurements of the current entering the electrodes can be used to monitor the progress of the preheating process. The electrode current will increase steadily until vaporization of water occurs at the electrode, at which time a drop in current will be observed. Additionally, temperature monitoring wells and/or numerical simulations may be used to determine the optimum time to commence continuous steam injection. The preheating phase should be completed within a short period of time. In this time, thermal conduction will establish relatively uniform heating adjacent to the thin highly conductive layers.

Once the preheating phase is completed, electrical heating is discontinued and the tar sand deposit is steam flooded to recover hydrocarbons present. Fluids other than steam, such as hot air or other gases, or hot water, may also be used to mobilize the hydrocarbons, and/or to drive the hydrocarbons to production wells.

The subsequent steam injection phase begins with continuous steam injection within the preheated zone adjacent to the high conductivity layer where the tar viscosity is lowest. Steam is initially injected adjacent to a shale layer and within the preheated zone. The steam flowing into the tar sand deposit effectively displaces oil toward the production wells. The steam injection and recovery phase of the process may take a number of years to complete. Because of the lack of vertical hydraulic communication, heat is only transferred vertically in the formation by thermal conduction. There will be some vertical movement of steam within geological sequences, but generally heat will have to be transferred to other producing sequences by thermal conduction from an already steam-produced sequence.

EXAMPLE

Numerical simulations were used to evaluate the feasibility of electrically preheating a thin, highly conductive layer within a tar sand deposit, and subsequently injecting steam. The numerical simulations required an input function of electrical conductivity versus temperature. The change in electrical conductivity of a typical Athabasca tar sand with temperature may be described by the equation:

$$\frac{C}{T + 22^\circ} = \text{constant}$$

where C is the electrical conductivity and T is the temperature in degrees Centigrade. Thus there is an increase in conductivity by about a factor of three as the temperature rises from 20° C. (T+22°=42°) to 100° C. (T=22°=122°). These simulations also required an input function of viscosity versus temperature. For example, the viscosity at 15° C. is about 1.2 million cp, whereas the viscosity at 105° C. is reduced to about 200 cp. In a sand with a permeability of 3 darcies, steam at typical field conditions can be injected continuously once the viscosity of the tar is reduced to about 10,000 cp, which occurs at a temperature of about 50° C. Also, where initial injectivity is limited, a few "huff-and-puff" steam injection cycles may be sufficient to overcome localized high viscosity.

The amount of electrical power generated in a volume of material, such as a subterranean, hydrocarbon-bearing deposit, is given by the expression:

$$P=CE^2$$

where P is the power generated, C is the conductivity, and E is the electric field intensity. For constant potential boundary conditions, such as those maintained at the electrodes, the electric field distribution is set by the geometry of the electrode array. The heating is then determined by the conductivity distribution of the deposit. The more conductive layers in the deposit will heat more rapidly. Moreover, as the temperature of a layer rises, the conductivity of that layer increases, so that the highly conductive layers will generate heat still more rapidly than the surrounding layers. This continues until vaporization of water occurs in the highly conductive layer, at which time its conductivity will decrease. Consequently, it is preferred to keep the temperature within the highly conductive layer below the boiling point of water at the insitu pressure.

FIG. 1 shows a typical configuration of the present invention and is a plan view of a well pattern for electrode wells for heating a tar sand deposit, and steam injection and production wells for recovering hydrocarbons from the deposit. The configuration shown in FIG. 1 is used as a model in the following computer simulations. The instantaneous positively excited horizontal electrodes (10) and the negatively excited horizontal electrodes (15) are arranged in a repeating pattern of (+) (−) (−) (+). Distances (22) and (20) are the distances between paired electrodes, and between non-paired electrodes respectively. Wells (11) and (12) are injector and producer wells respectively. Zones (14) and (13) are electrically heated and non-electrically heated zones, respectively.

Figure 3:
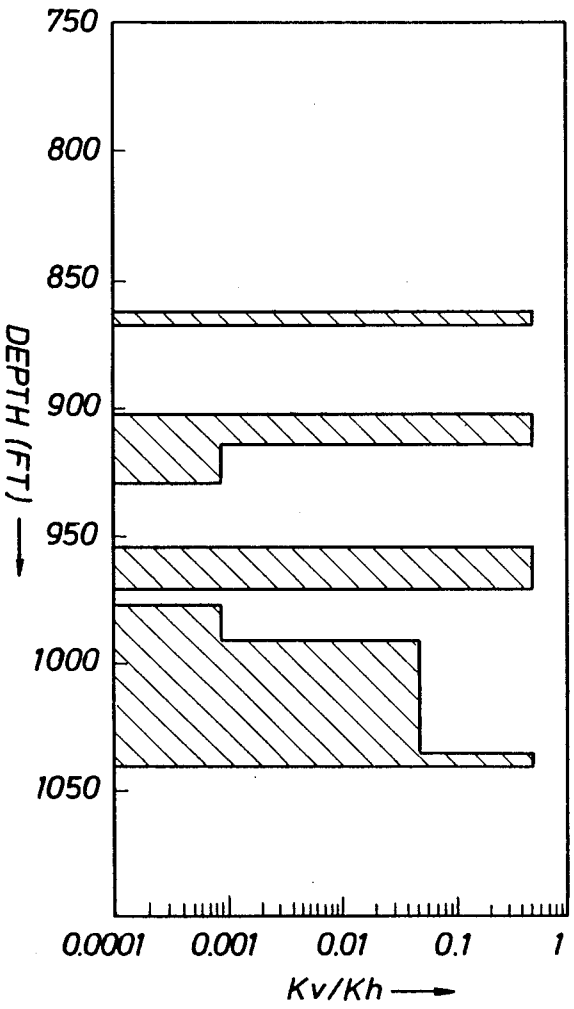
FIG. 3 shows Kv/Kh of a simulated reservoir as a function of depth.
Figure 2:
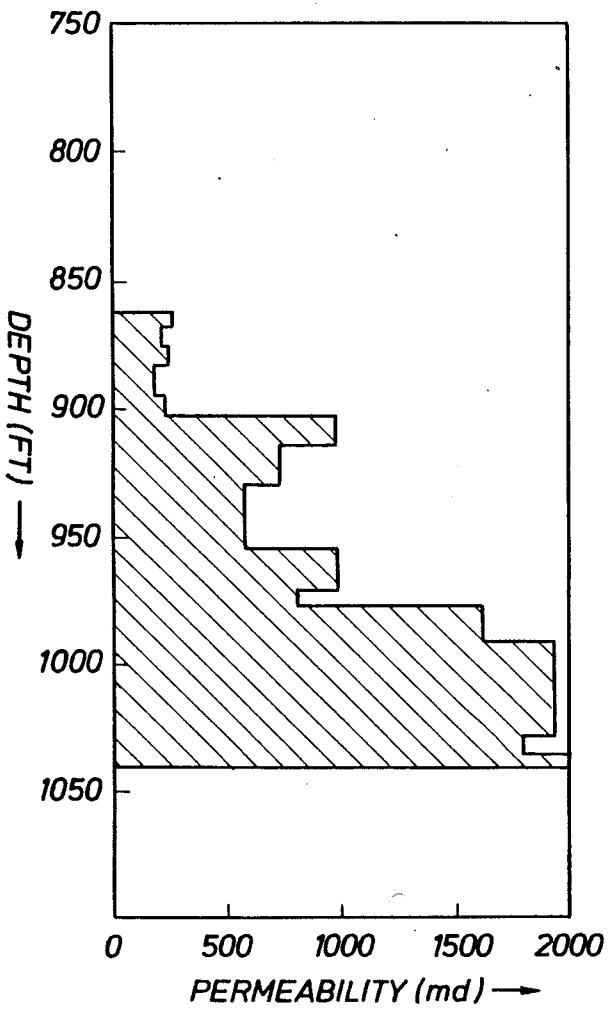
FIG. 2 shows permeability of a simulated reservoir as a function of depth.
Figure 7:
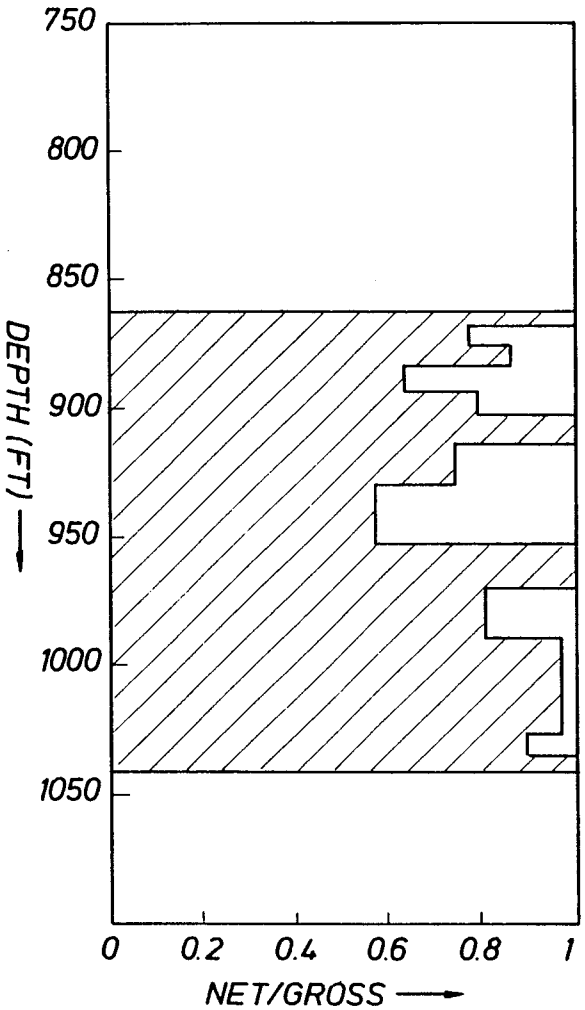
FIG. 7 shows Net/Gross of a simulated reservoir as a function of depth.
Figure 6:
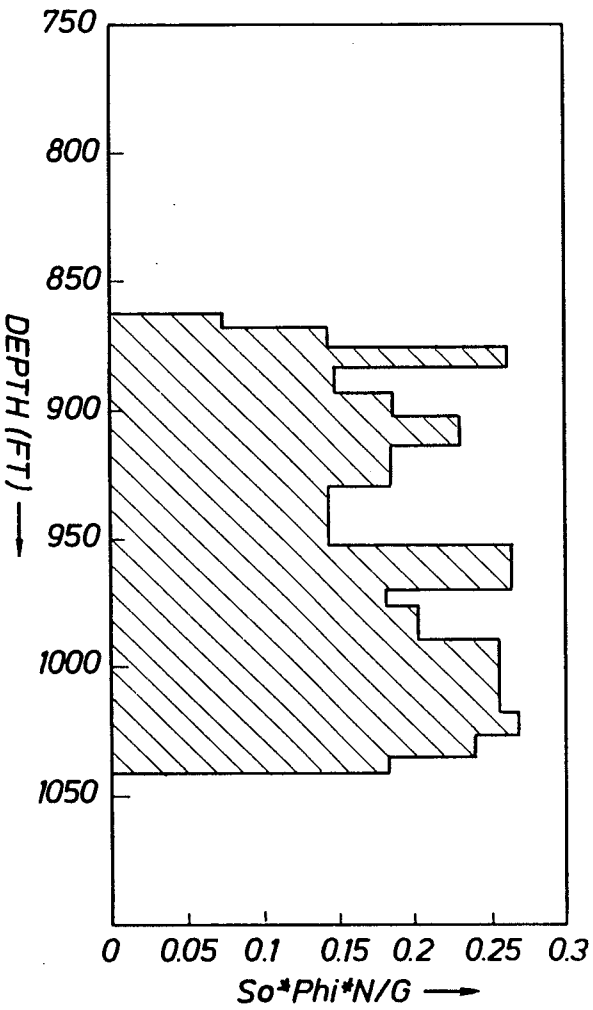
FIG. 6 shows So*phi*N/G of a simulated reservoir as a function of depth.
Figure 5:
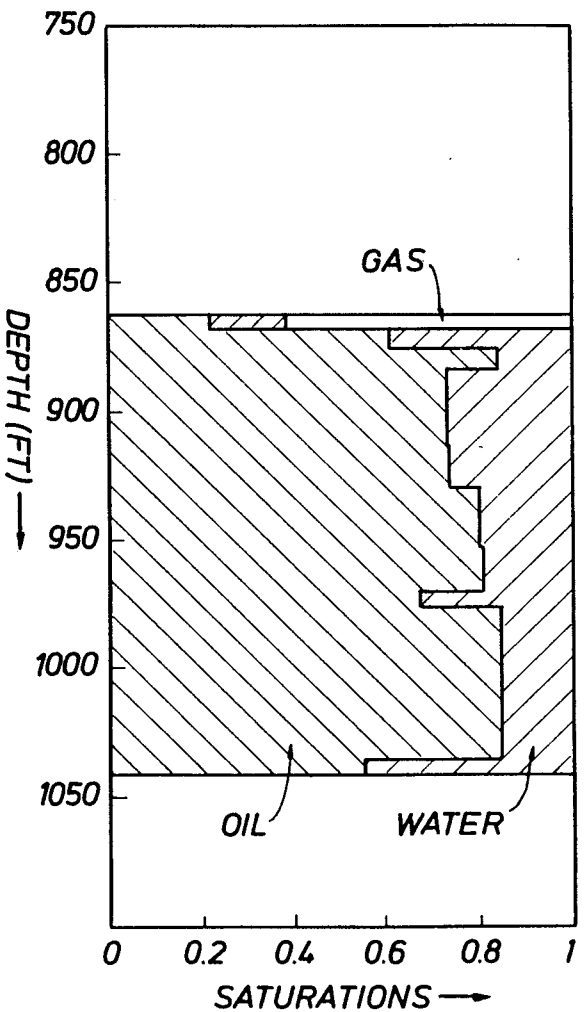
FIG. 5 shows saturation of a simulated reservoir as a function of depth.

FIGS. 2 through 7 show the reservoir properties as a function of depth for the simulated reservoir. The target highly conductive layer is the layer at about 970–975 feet as shown on the resistivity plot of FIG. 2.

Since in actual practice it is not always possible to place the horizontal electrodes exactly in the target layer, the following examples examine the sensitivity of the invention to the placement of the electrodes. In Case 1 the electrodes are placed above the target layer in the upper sand (960–965 feet). In Case 2 the electrodes are placed in the target layer, and in Case 3 the electrodes are placed below the target layer in the lower sand (1000–1005 feet).

FIG. 8 shows the recovery of the original oil in place (OOIP) of the reservoir as a function of time.

The parameters set for the electric preheating numerical simulation are shown in Table 1.

TABLE 1

| | Case 1 | Case 2 | Case 3 |
|---|---|---|---|
| Horizontal electrode drilled in | upper sand | shale | lower sand |
| interelectrode distance | | | |
| non-paired, feet | 90 | 90 | 90 |
| paired, feet | 120 | 120 | 120 |
| electrode diameter, inches | 9.875 | 9.875 | 9.875 |
| applied voltage, volts | 420 | 400 | 530 |
| maximum current per unit electrode length, amp/ft | 3.5 | 4.3 | 3.1 |
| heating time, years | 1.5 | 1.5 | 1.5 |
| max electrode temperature, °F. | 586 | 460 | 584 |
| heat injection, kW-hr/bbl of oil in place | 8.9 | 10.6 | 8.9 |

In the three cases, simultaneous electric heating and steam soaking were conducted for about 1.5 years, followed by one more year of steam soaking, followed by a steam drive. FIG. 8 shows that Case 2, where the horizontal electrode is placed in the target highly conductive layer, has the best recovery.

The oil recovery and steam injection rates for a five-acre pattern using the proposed process are more akin to conventional heavy oil developments than to tar sands with no steam injectivity. In all three cases, the total electrical energy utilized was less than 10 percent of the equivalent energy in steam utilized in producing the deposit, thus, the ratio of electrical energy to steam energy was very favorable. Also, the economics of the process in all three cases is significantly improved relative to the prior art proposals of uniform electrical heating of an entire tar sand deposit.

Significant energy savings can be realized when the electrodes span a thin highly conductive layer such as a shale layer within a tar sand deposit. Preheating a thin highly conductive layer substantially confines the electrical current in the vertical direction, minimizes the amount of expensive electrical energy dissipated outside the tar sand deposit, and provides a thin preheated zone of reduced viscosity within the tar sand deposit that allows subsequent steam injection.

The three cases of the example show as expected, the invention is more efficient when the horizontal electrode is placed in the target highly conductive layer (Case 2). Of course, Cases 1 and 3 show that the invention is operational even when the electrode is placed in the layer just above or just below the target layer. This is important because it is not always possible to drill the horizontal electrode exactly into the target layer. In Cases 1 and 3, since the current will follow the path of least resistance between the electrodes, a part of the travel path of the current will be through the target highly conductive layer. Since part of the travel path is through the upper or lower sand, inefficiencies are introduced, thus contributing to the somewhat lower recovery as compared to Case 2. Since part of the travel path is through the target highly conductive layer, there is some heating of the target highly conductive layer, thus contributing to a somewhat improved efficiency over conventional methods.

Having discussed the invention with reference to certain of its preferred embodiments, it is pointed out that the embodiments discussed are illustrative rather than limiting in nature, and that many variations and modifications are possible within the scope of the invention. Many such variations and modifications may be considered obvious and desirable to those skilled in the art based upon a review of the figures and the foregoing description of preferred embodiments.

What is claimed is:

1. A process for recovering hydrocarbons from hydrocarbon-bearing deposits containing thin highly conductive layers adjacent to at lease one hydrocarbon rich zone, the process comprising the steps of:

selecting a hydrocarbon-bearing deposit which contains a thin highly conductive layer within the deposit;

installing at least one pair of horizontal electrodes spanning the highly conductive layer and dividing the layer into electrically heated and non-electrically heated zones;

providing at least one vertical injection well for hot fluid injection into the hydrocarbon rich zone;

providing at least one vertical production well for production of hydrocarbons;

electrically heating the thin highly conductive layer to form a preheated zone immediately adjacent to the thin highly conductive layer while simultaneously stimulating the wells with steam;

injecting the hot fluid into the deposit adjacent to the thin highly conductive layer and within the thin preheated zone to displace the hydrocarbons to the production wells; and recovering hydrocarbons from the production wells.

2. The process of claim 1 wherein the vertical production well is located in the electrically heated zone.

3. The process of claim 1 wherein the vertical injection well is located in the electrically heated zone.

4. The process of claim 1 wherein the vertical injection well and the vertical production well are both located in the electrically heated zone.

5. The process of claim 1 wherein the hot fluid is water.

6. The process of claim 1 wherein the hot fluid is air.

7. The process of claim 1 wherein the horizontal electrode is the horizontal portion of a well that has been electrically excited.

8. A process for recovering hydrocarbons from hydrocarbon bearing deposits containing thin highly conductive layers adjacent to at least one hydrocarbon rich zone, the process comprising the steps of:

selecting a hydrocarbon-bearing deposit which contains a thin highly conductive layer within the deposit;

installing at least one pair of horizontal electrodes spanning the highly conductive layer and dividing the layer into electrically heated and non-electrically heated zones;

providing at least one vertical injection well for steam injection into the hydrocarbon rich zone;

providing at least one vertical production well for production of hydrocarbons;

electrically heating the thin highly conductive layer to form a preheated zone immediately adjacent to the thin highly conductive layer while simultaneously stimulating the wells with steam;

injecting steam into the deposit adjacent to the thin highly conductive layer and within the thin preheated zone to displace the hydrocarbons to the production wells; and recovering hydrocarbons from the production wells.

9. The process of claim 8 wherein the vertical production well is located in the electrically heated zone.

10. The process of claim 8 wherein the vertical injection well is located in the electrically heated zone.

11. The process of claim 8 wherein the vertical injection well and the vertical production well are both located in the electrically heated zone.

12. The process of claim 8 wherein the horizontal electrode is the horizontal portion of a well that has been electrically excited.

13. A process for increasing the injectivity of a hydrocarbon bearing deposit containing thin highly conductive layers adjacent to at least one hydrocarbon rich zone, the process comprising the steps of:

selecting a hydrocarbon-bearing deposit which contains a thin highly conductive layer within the deposit;

installing at least one pair of horizontal electrodes spanning the highly conductive layer and dividing the layer into electrically heated and non-electrically heated zones;

providing at least one vertical injection well for hot fluid injection into the hydrocarbon rich zone;

electrically heating the highly conductive layer to form a preheated zone immediately adjacent to the thin highly conductive layer while simultaneously stimulating the wells with steam.

14. The process of claim 13 wherein the vertical injection well is located in the electrically heated zone.

15. The process of claim 13 wherein the hot fluid is steam.

16. The process of claim 13 wherein the hot fluid is water.

17. An apparatus for recovering hydrocarbons from tar sand deposits containing highly conductive layers comprising:

at least two pairs of horizontal electrodes which span the highly conductive layer and divide the highly conductive layer into at least two horizontally displaced electrically heated zones separated by non-electrically heated zones;

at least one vertical injection well; and at least one vertical production well.

18. The apparatus of claim 17 wherein the vertical production well is located in one of the electrically heated zones.

19. The apparatus of claim 17 wherein the vertical injection well is located in the electrically heated zone.

20. The apparatus of claim 17 wherein the vertical injection well and the vertical production well are both located in one of the electrically heated zones.

21. The apparatus of claim 17 wherein the horizontal electrode is the horizontal portion of a well that has been electrically excited.

22. An apparatus for improving the injectivity of a hydrocarbon bearing deposit containing highly conductive layers comprising:

at least two pairs of horizontal electrodes which span and are in contact with the highly conductive layer and divide the highly conductive layer into at least two horizontally displaced electrically heated zones separated by non-electrically heated zones; and at least one vertical injection well in the electrically heated zones.

23. The apparatus of claim 22 wherein the horizontal electrode is the horizontal portion of a well that has been electrically excited.

* * * * *